US006688246B2

(12) United States Patent
Sadasue et al.

(10) Patent No.: US 6,688,246 B2
(45) Date of Patent: Feb. 10, 2004

(54) LOOP HOLDING DEVICE OF CHAIN STITCH SEWING MACHINE

(75) Inventors: Kazuya Sadasue, Chofu (JP); Satoru Nishimura, Chofu (JP)

(73) Assignee: Juki Corporation, Tokyo (JP)

( * ) Notice: Subject to any disclaimer, the term of this patent is extended or adjusted under 35 U.S.C. 154(b) by 39 days.

(21) Appl. No.: 10/174,418

(22) Filed: Jun. 17, 2002

(65) Prior Publication Data

US 2003/0005871 A1 Jan. 9, 2003

(30) Foreign Application Priority Data

Jun. 18, 2001 (JP) ..... P. 2001-182678

(51) Int. Cl.[7] ..... B06F 1/08; B06F 27/02
(52) U.S. Cl. ..... 112/127; 112/319
(58) Field of Search ..... 112/165, 197, 112/288, 311, 324, 323, 303, 312, 313, 319, 260

(56) References Cited

U.S. PATENT DOCUMENTS 1,074,968 A * 10/1913 Merrow ..... 112/312
2,228,220 A * 1/1941 Anton ..... 112/312
3,320,915 A * 5/1967 Steiner ..... 112/253
3,358,630 A * 12/1967 Maddi et al. ..... 112/288
3,712,256 A * 1/1973 Striegler et al. ..... 112/288
4,479,449 A * 10/1984 Raiche ..... 112/312

* cited by examiner

*Primary Examiner*—Ismael Izaguirre
(74) *Attorney, Agent, or Firm*—Merchant & Gould, P.C.

(57) ABSTRACT

A chain stitch sewing machine comprises a needle for penetrating through a cloth on a throat plate to be vertically moved interlockingly with a main spindle of the sewing machine, thereby holding a needle thread, a cloth presser mounted on the throat plate and serving to press the cloth, a looper having a looper thread for reciprocating in such a direction as to cross a cloth feeding direction below the throat plate interlockingly with the main spindle of the sewing machine, a main feed dog for feeding a loop formed by the needle thread and the looper thread in cooperation of the needle and the looper rearward in the cloth feeding direction, and a loop engagement member for protruding from an upper surface of the throat plate and engaging the loop with the cloth presser when the main feed dog is descending from the upper surface of the throat plate.

3 Claims, 4 Drawing Sheets

LOOP HOLDING DEVICE OF CHAIN STITCH SEWING MACHINE

BACKGROUND OF THE INVENTION

1. Field of the Invention

The present invention relates to a loop holding device of a chain stitch sewing machine, and more particularly to a loop engaging device of a chain stitch sewing machine which continuously forms a loop stitch by a needle thread and a looper thread.

2. Description of the Related Art

A loop holding device of a sewing machine of this type shown in FIGS. 7 and 8 has been known.

The well-known chain stitch sewing machine can form both an over-edge chain stitch and a covering chain stitch.

FIG. 7 is a side view showing a cloth presser 10, and 10A denotes a support member which can be freely attached to and removed from the lower end of a presser rod which is not shown. 10B denotes a cloth presser and a shaft 10C in a horizontal direction thereof can be attached to and removed from the lower end of the support member 10A by means of a lever 10D. 10E denotes a spring and has a base portion supported on a shaft 10F of the support member 10A. The tip of the spring 10E abuts on the forward upper surface of the cloth presser 10B and serves to energize the cloth presser 10B in a clockwise direction around the shaft 10C. 10G denotes a loop presser, and is rotatably supported by a shaft 10H in a horizontal direction with respect to the cloth presser 10B and is energized in the clockwise direction by means of a spring 10I. The loop presser 10G is constituted such that a tip thereof is positioned below the lower surface of the cloth presser 10B by the function of the spring 10I as shown in FIG. 7 when the presser rod which is not shown is lifted.

FIG. 8 is a plan view showing a throat plate 20 according to the conventional art, and three needle holes 20A for needle location parts through which three needles N for a covering chain stitch penetrate are formed in a central part and a loop guide hole 20B is formed in the forward cloth feeding direction of the needle hole 20A, and the needle hole 20A and the guide hole 20B are caused to communicate through three slits 20C which are parallel with the cloth feeding direction. Two threading pieces 20D are formed by the slit 20C.

Moreover, the throat plate 20 is provided with a needle hole 20E for an over-edge chain stitch and a threading piece 20F on the right side of a portion in which the needle hole 20A is formed.

Furthermore, the throat plate 20 is provided with a cloth feed dog hole 20G from which an accessory feed dog frequently appears on this side and left side in the cloth feeding direction of the needle hole 20A, and a feed dog hole 20J from which a loop feed dog 20H and a main feed dog 20I frequently appear is formed in a rear part in the cloth feeding direction of the needle hole 20A.

Next, functions will be described.

When the sewing machine is driven, the three needles N are vertically moved interlockingly with a main spindle which is not shown, a looper which is not shown is rocked to describe an elliptic locus around the needle, and the accessory feed dog and the main feed dog 20I carry out four motions for cloth feeding.

Consequently, when the cloth presser 10B descends and comes in contact with the upper surface of the throat plate 20 without a cloth put on the lower surface of the cloth presser 10B, a loop is formed between the lower surface of the cloth presser 10B and the upper surface of the throat plate 20 by the needle thread of the needle N and the looper thread of the looper which is not shown and is pressed by the loop presser 10G.

Moreover, when the cloth is present between the lower surface of the cloth presser 10B and the upper surface of the throat plate 20, it is fed by the cloth feed dog in the cloth feeding direction and a stitch is formed on the cloth by the needle thread of the needle N and the looper thread of the looper which is not shown.

However, the conventional art has the following problems.

More specifically, as shown in FIG. 7, when the cloth presser 10B is lifted, the tip of the loop presser 10G protrudes downward from the lower surface of the cloth presser 10B by the function of the spring 10I.

For this reason, when the cloth is to be set between the upper surface of the throat plate 20 and the lower surface of the cloth presser 10B, the cloth abuts on the tip of the loop presser 10G protruding downward from the lower surface of the cloth presser 10B. Consequently, there is a problem in that a cloth setting property is poor and a sewing work efficiency is deteriorated. In particular, this problem is remarkable when a thick cloth is to be set.

Moreover, holding force for pressing and holding a loop against the upper surface of the throat plate 20 by means of the loop presser 10G is determined by the elastic force of the spring 10I. If the holding force of the loop by the elastic force of the spring 10I is small, the loop is pulled in a reverse direction to the cloth feeding direction depending on thread fastening for the needle thread so that the loop cannot be formed stably and continuously.

Moreover, in the case in which a step is made between the lower surface of the loop presser 10G and that of the cloth presser 10B, the loop cannot be held between the lower surface of a loop pressing portion and the upper surface of the throat plate. In order to eliminate the step, a highly developed processing technique is required.

SUMMARY OF THE INVENTION

In order to solve the conventional problem, a first aspect of the invention is directed to a loop holding device of a chain stitch sewing machine comprising:

- a needle for penetrating through a cloth on a throat plate to be vertically moved interlockingly with a main spindle of the sewing machine, thereby holding a needle thread;
- a cloth presser provided on the throat plate and serving to press the cloth;
- a looper having a looper thread for reciprocating in such a direction as to cross a cloth feeding direction below the throat plate interlockingly with the main spindle of the sewing machine;
- a main feed dog for feeding a loop formed by the needle thread and the looper thread in cooperation of the needle and the looper rearward in the cloth feeding direction; and
- a loop engagement member for upward protruding from an upper surface of the throat plate and engaging the loop when the main feed dog is descending from the upper surface of the throat plate.

According to the first aspect of the invention, if the loop presser is brought down from the upper surface of the loop presser when the cloth presser is lifted, nothing protrudes between the upper surface of the throat plate 30 and the lower surface of the cloth presser. Therefore, a cloth setting property between the upper surface of the throat plate 30 and the lower surface of the cloth presser can be improved and the effect of enhancing a sewing work efficiency can be obtained, and particularly, the effect of enhancing a thick cloth setting property can be obtained.

A second aspect of the invention is directed to the loop holding device of a chain stitch sewing machine according to the first aspect of the invention, wherein the loop engagement member is provided between a main feed dog and a needle location part.

According to the second aspect of the invention, it is possible to obtain such an advantage as to more enhance the effect according to the first aspect of the invention.

A third aspect of the invention is directed to the loop holding device of a chain stitch sewing machine according to the first or second aspect of the invention, wherein the loop engagement member can adjust upper and lower positions.

According to the third aspect of the invention, it is possible to regulate the holding force of the loop over the lower surface of the cloth presser by the loop engagement member, thereby corresponding to the strength of thread fastening for the needle thread. Therefore, it is possible to obtain an effect that the loop can be prevented from being pulled in a reverse direction to the cloth feeding direction and can be formed stably and continuously.

DESCRIPTION OF THE PREFERRED EMBODIMENTS

An embodiment of the invention will be described below with reference to FIGS. 1 to 6.

Figure 1:
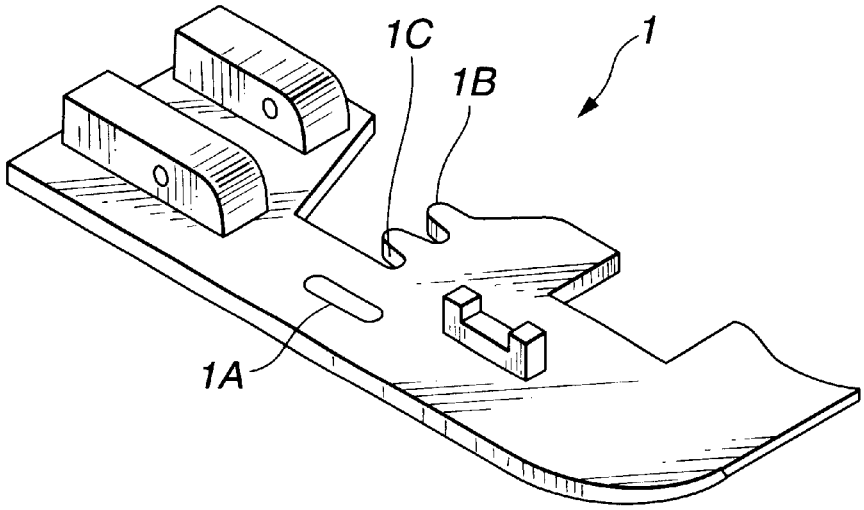
FIG. 1 is a perspective view showing a cloth presser according to the invention.

FIG. 1 is a perspective view showing a cloth presser 1, and the cloth presser 1 is provided with a long needle hole 1A and two needle holes 1C having two threading pieces 1B in a cloth feeding direction as is well known.

Figure 2:
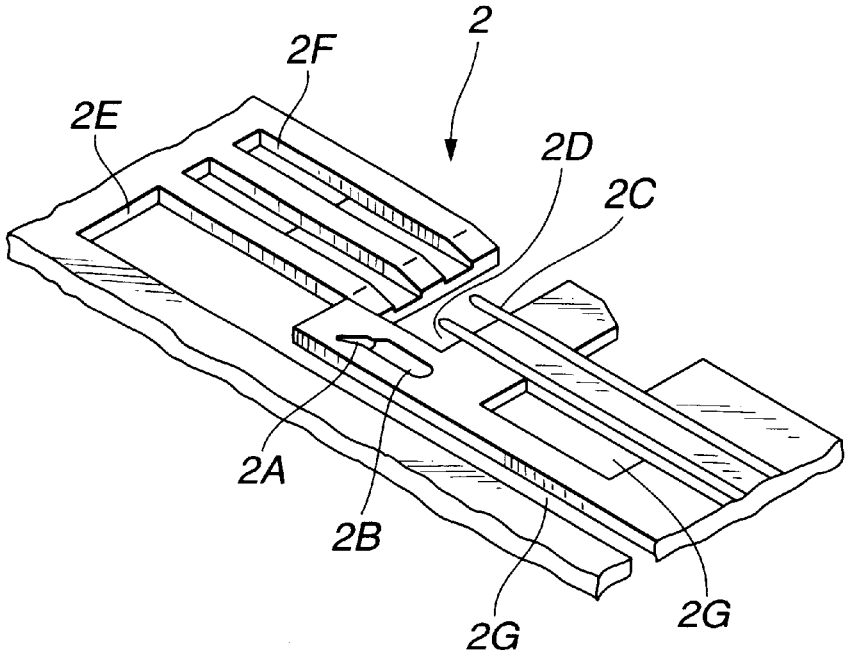
FIG. 2 is a perspective view showing a throat plate according to the invention.

FIG. 2 is a perspective view showing a throat plate 2 and the throat plate 2 is provided with a needle hole 2B having a loop guide groove 2A in a forward part in the cloth feeding direction to be long in the cloth feeding direction corresponding to the needle hole 1A of FIG. 1.

Moreover, the throat plate 2 is provided with two threading pieces 2C corresponding to the two threading pieces 1B of the cloth presser 1 and a needle hole 2D, and a main feed dog hole 2E having a great width in the forward part in the cloth feeding direction of the needle hole 2C in which the loop guide groove 2A is formed and a main feed dog hole 2F having a small width in the forward part in the cloth feeding direction of the needle hole 2D. Furthermore, the throat plate 2 is provided with an accessory feed dog hole 2G on this side in the cloth feeding direction of the needle hole 2B.

Figure 3:
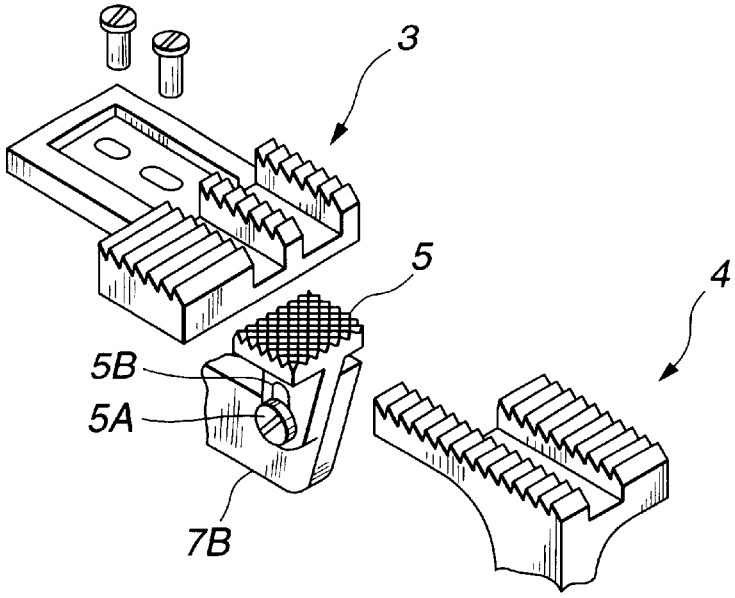
FIG. 3 is an exploded perspective view showing a cloth feed dog and a loop presser according to the invention.
Figure 4:
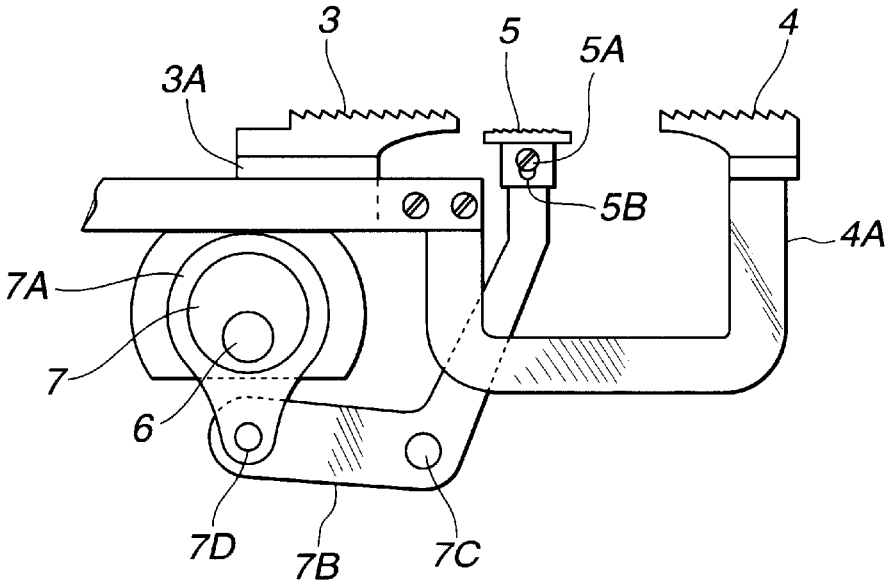
FIG. 4 is a side view showing a driving mechanism for the loop presser according to the invention.

FIG. 3 is a perspective view showing a main feed dog 3, an accessory feed dog 4 and a loop presser 5 to be a loop engagement member, and the main feed dog 3 is fixed to a well-known cloth feeding table 3A shown in FIG. 4 with a screw 3B, the accessory feed dog 4 is fixed to a well-known cloth feeding table 4A shown in FIG. 4, and the main feed dog 3 and the accessory feed dog 4 frequently appear from the main feed dog holes 2E and 2F and the accessory feed dog hole 2G in the throat plate 2 to carry out well-known four motions for cloth feeding.

FIG. 4 is a view illustrating a driving mechanism for the loop presser 5, and 6 denotes the main spindle of a sewing machine and an eccentric cam 7 is fixed to the main spindle 6 and the upper end of a link 7A is movably fitted in the eccentric cam 7. 7B denotes an L-shaped interlocking link and a central part thereof is rotatably supported on a shaft 7C fixed to a sewing machine frame which is not shown. The left end of the interlocking link 7B is rotatably coupled to the lower end of the link 7A by means of a shaft 7D, and the loop presser 5 appearing frequently upward from the throat plate 2 through the main feed dog hole 2E of the throat plate 2 is fixed to the upper end of the interlocking link 7B with a screw 5A through a slot 5B.

The eccentric cam 7 is fixed to the main spindle 6 for driving the loop presser 5. The eccentric cam 7 is fixed to the main spindle 6 by changing a phase at 180 degrees from an eccentric cam which serves to vertically move the main feed dog 3 and the accessory feed dog 4 and is not shown.

Next, description will be given to the function of the driving mechanism for the loop presser 5.

FIG. 4 shows a state in which the center of the eccentric cam 7 is provided just above the shaft center of the main spindle 6, and therefore, the link 7A is provided in an uppermost position so that the interlocking link 7B is rotated in a clockwise direction around the shaft 7C.

Figure 5:
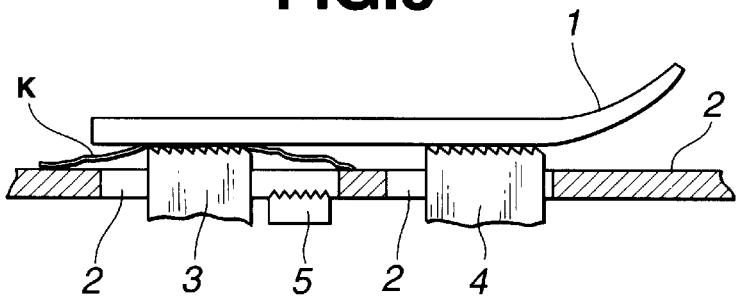
FIG. 5 is a view for explaining the function of the loop presser according to the invention.

This state is shown in FIG. 5, and the main feed dog 3 and the accessory feed dog 4 protrude upward from the main feed dog holes 2E and 2F and the accessory feed dog hole 2G in the throat plate 2 and are placed in the most lifting position and the loop presser 5 is placed in the most descending position.

When the sewing machine is driven so that the main spindle 6 shown in FIG. 4 is rotated in the clockwise direction in this state, the main feed dog 3 and the accessory feed dog 4 are moved in the cloth feeding direction to feed a loop K in the cloth feeding direction and to press down the link 7A by means of the eccentric cam 7, thereby rotating the interlocking link 7B around the shaft 7C through the shaft 7D in a half clockwise direction. Consequently, the loop presser 5 is gradually lifted.

Figure 6:
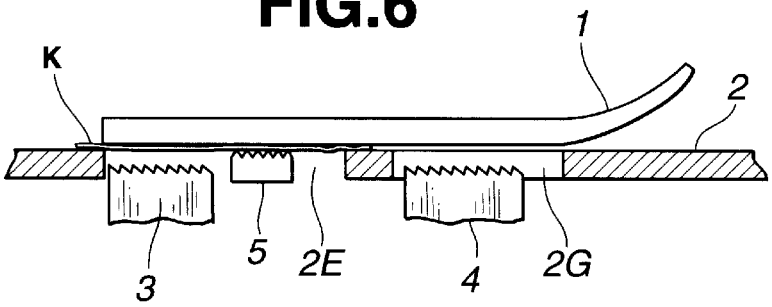
FIG. 6 is a view for explaining the function of the loop presser according to the invention.
Figure 7:
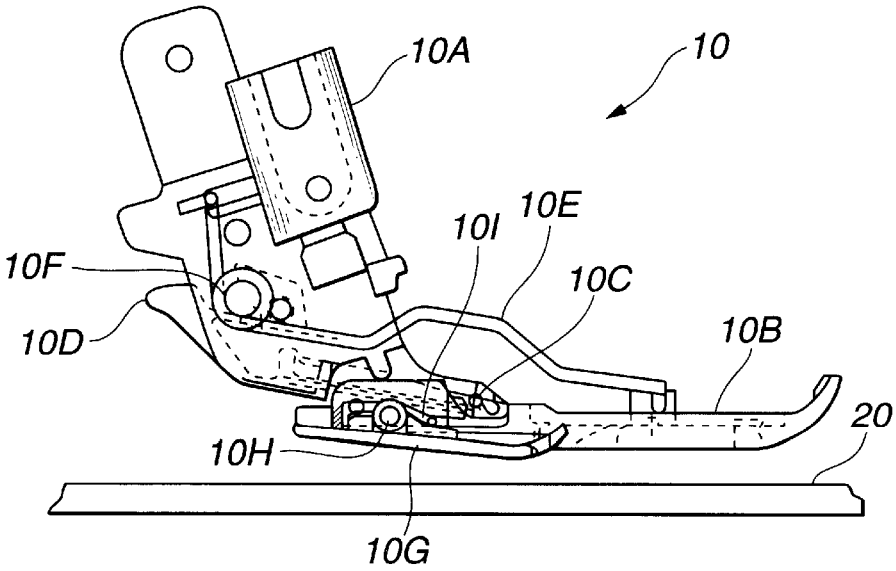
FIG. 7 is a side view showing a cloth presser and a throat plate according to a conventional art.
Figure 8:
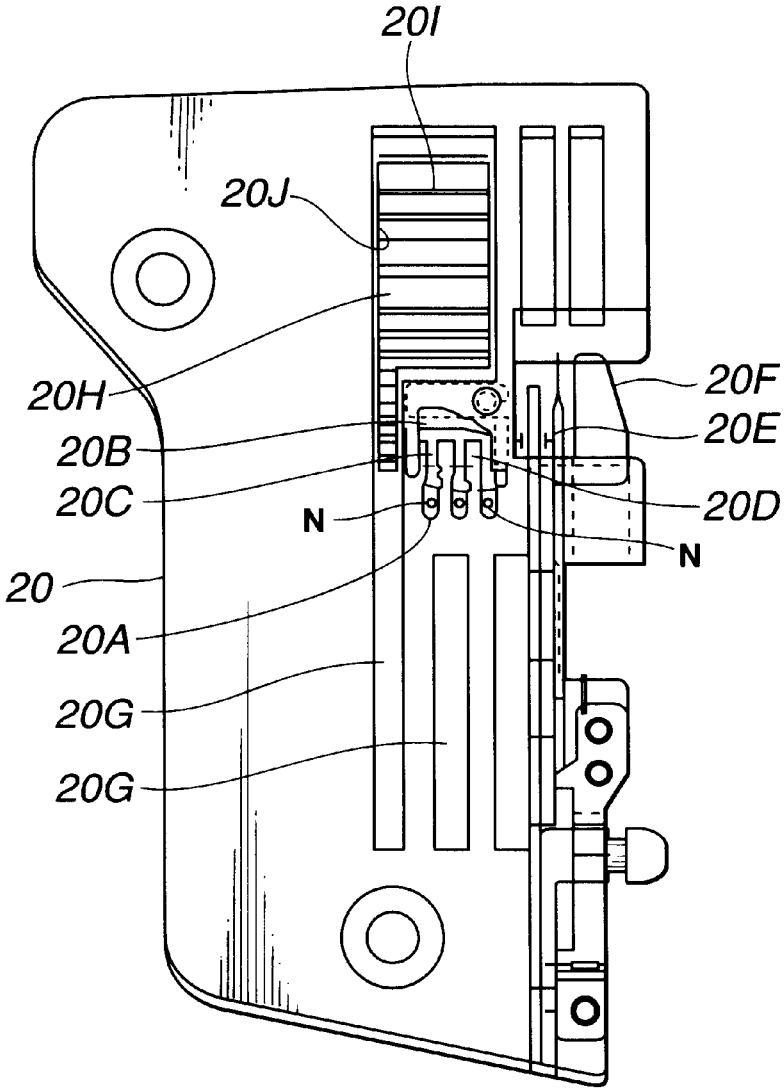
FIG. 8 is a plan view showing the throat plate according to the conventional art.

When the main feed dog 3 and the accessory feed dog 4 are brought down from the upper surface of the needle plate, the loop presser 5 protrudes from the upper surface of the needle plate 2 through the main feed dog hole 2E of the throat plate 2, thereby engaging the loop K with the lower surface of the cloth presser 1 as shown in FIG. 6. The engagement of the loop K with the lower surface of the cloth presser 1 through the loop presser 5 is maintained until the main feed dog 3 and the accessory feed dog 4 are then lifted to the upper surface of the throat plate.

Moreover, the loop presser 5 can be moved vertically by loosening the screw 5A shown in FIGS. 3 and 4 and the upper and lower positions of the loop presser 5 can be then regulated by fastening the screw 5A. Therefore, contact pressing force against the lower surface of the cloth presser generated by the loop presser 5 to be the loop engagement member can be caused to be variable, thereby regulating force for holding the loop.

The driving mechanism for the loop presser 5 shown in FIG. 4 is not restricted to such a mechanism but it is also possible to easily suppose that an actuator is used and is driven in response to a needle position signal, for example.

As described above, in the invention, when the cloth presser is lifted, nothing protrudes between the upper surface of the throat plate and the lower surface of the cloth presser if the loop presser is brought down from the lower surface of the throat plate. Consequently, it is possible to obtain such an effect that a cloth setting property between the upper surface of the throat plate and the lower surface of the cloth presser can be improved and a sewing work efficiency can be enhanced, and particularly, a thick cloth setting property can be enhanced.

In the invention, moreover, it is possible to regulate the force for holding the loop over the lower surface of the cloth presser by the loop engagement member and to correspond to the strength of needle fastening for the needle thread. Therefore, it is possible to obtain such an effect that the loop can be prevented from being pulled in the reverse direction to the cloth feeding direction and can be formed stably and continuously.

What is claimed is:

1. A loop holding device of a chain stitch sewing machine comprising:

a needle for penetrating through a cloth on a throat plate to be vertically moved interlockingly with a main spindle of the sewing machine, thereby holding a needle thread;

a cloth presser provided on the throat plate and serving to press the cloth;

a looper having a looper thread for reciprocating in such a direction as to cross a cloth feeding direction below the throat plate interlockingly with the main spindle of the sewing machine;

a main feed dog for feeding a loop formed by the needle thread and the looper thread in cooperation of the needle and the looper rearward in the cloth feeding direction; and a loop engagement member for upward protruding from an upper surface of the throat plate and engaging the loop when the main feed dog is descending from the upper surface of the throat plate.

2. The loop holding device of a chain stitch sewing machine according to claim 1, wherein the loop engagement member is provided between a main feed dog and a needle location part.

3. The loop holding device of a chain stitch sewing machine according to claim 1, wherein the loop engagement member can adjust upper and lower positions.

* * * * *